US006089165A

United States Patent [19]

Polley et al.

[11] Patent Number: 6,089,165

[45] **Date of Patent: *Jul. 18, 2000**

[54] RAILWAY TRUCK WITH UNDERSLUNG EQUILIZER BEAMS

[75] Inventors: Richard B. Polley, Gahanna; Roger F. Sanzo, Columbus; William C. Jones, Jr., Reynoldsburg; Todd A. Porter, Newark, all of Ohio

[73] Assignee: Buckeye Steel Castings, Columbus, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 09/047,746

[22] Filed: Mar. 24, 1998

[51] Int. Cl.[7] ..... B61F 5/00

[52] U.S. Cl. ..... 105/194

[58] Field of Search ..... 105/157.1, 182.1, 105/194, 195, 208, 208.1, 208.2, 209, 218.1

[56] References Cited

U.S. PATENT DOCUMENTS

| | | | |
|---|---|---|---|
| 59,021 | 10/1866 | Howard | 105/194 |
| 61,461 | 1/1867 | Reynolds | 105/194 |
| 753,626 | 3/1904 | Price | 105/194 |
| 757,927 | 4/1904 | Hoy | 105/194 |
| 1,866,839 | 7/1932 | Bruce | 105/194 |
| 2,710,676 | 6/1955 | McCormick | 105/194 |
| 3,451,354 | 6/1969 | Dowling | 105/195 |
| 4,538,524 | 9/1985 | Eggert, Jr. | 105/182 R |

FOREIGN PATENT DOCUMENTS

| | | |
|---|---|---|
| 64319 | 1/1925 | Switzerland . |

*Primary Examiner*—Mark T. Le
*Attorney, Agent, or Firm*—Banner & Witcoff, Ltd.

[57] ABSTRACT

A railway vehicle truck assembly comprises the following, in part: wheel sets having longitudinally spaced, transversely extending axles, and wheels mounted to the axles; transversely spaced longitudinally extending truck frames mounted to the axles; and a transversely extending bolster mounted to the truck frames. The bolster has a center bowl and opposed, elongated bolster arms extending from the center bowl. An underslung equalizer beam is located below the axles and mounted to the axle boxes. Brake beam guides are located in the equalizer spring seats which are located on the underslung equalizer beam. The equalizer beam is hot-box detector compatible so as to not interfere with the axle bearing detection scanners located alongside the railroad track.

6 Claims, 5 Drawing Sheets

RAILWAY TRUCK WITH UNDERSLUNG EQUILIZER BEAMS

BACKGROUND OF THE INVENTION

1. Field of the Invention

The present invention relates in general to improved trucks for railway cars. More specifically, but without restriction to the particular use which is shown and described, this invention relates to underslung equalizer beams that are hot-box detector compatible and accomodate conventional brake beams.

2. Description of the Related Art

Equalizer beams are a device in the railroad industry whose purpose is to provide superior wheel load equalization. Wheel load equalization is a measure of the railway tuck's ability to safely traverse uneven railroad track where one wheel is raised or lowered relative to the other three wheels. With conventional trucks, primary spring suspensions are located on the vertical center line of the axles. In contrast, with an equalizer spring truck, the primary suspension (equalizer springs) is located atop the equalizer beam and inboard of the axle center lines. By locating the primary suspension longitudinally inboard of the axle center lines, springs of the same rate provide superior wheel load equalization compared to springs at the axles. The reason for the superior wheel load equalization with the primary suspension inboard of the axle center lines is based on the location of the primary springs. With springs at the axle centerline, when one wheel is raised, the primary spring at that journal must deflect an amount equal to the wheel rise. With an equalizer beam, when one wheel is raised, the primary spring (equalizer spring) only has to deflect a fraction of the wheel rise because of the location of the spring. Thus, for primary springs of equal rate, the equalizer beam truck provides dramatically better wheel load equalization compared to springs located at the axleboxes. Consequently, for high speed operation on rough track, the equalizer beam truck is superior in safety.

Conventional equalizer beams longitudinally span the spaced-apart axles of the truck wheels. The equalizer beams have a generally drop or "gooseneck" shape at each end so that the beam is supported atop the axleboxes. Near its center, the equalizer beam drops down to support the equalizer springs. Traditionally, there are two types of equalizer beams, the single equalizer and the dual equalizer. The single equalizer has only one beam on each side of the truck passing through the bottom wall of the truck frame on the journal centerline. The dual equalizer beam uses two beams on each side of the truck located equidistant transversely inboard and outboard of the truck frame. The dual equalizers are, of course, more costly than a single beam, but do not pass through the truck frame.

Conventionally, equalizer beams have been steel forgings. The dies and consequently the forged beams were and still are very expensive. In the recent past, safe equalizer beams have been manufactured from high-strength steel plates. However, steel plate is still expensive and because of the drop or "gooseneck" shape of the equalizer beams, cutting of the beams results in a significant amount of offal. Moreover, as will be more fully discussed below, conventional equalizer beams shield a significant portion of the axle bearings from view and thus prevent the detection of overheated axle bearings by wayside hot-box detectors.

One of the more serious problems with railway cars and more specifically with the axle bearings is that as the bearings wear out, the bearings will overheat and potentially cause serious railcar derailments. In the past, the detection of overheating axle bearings required the train crew in the caboose, while the train was in transit, to monitor the truck wheels for bearing smoke which indicated overheating. Today, the railroad industry uses what are termed hot-box detection scanners which are located along the side of the railroad track. These scanners, also known as hot-box detectors, monitor the temperature of the axle bearings by sensing the temperature of each bearing as the train travels by. As the train continues past the detector, the detector signals to the train engineer how many axle bearings it scanned, how many bearings were good and how many were bad, that is, too hot. The detector also signals where the hot bearings are located.

For the hot-box detectors to work effectively, the detectors must be able to sense the axle bearings and not be obstructed by truck component structure. To ensure the hot-box detectors have an unobstructed view of the axle bearings, the Association of American Railroads "AAR" sets forth criteria for limiting the location of component structure around the axle bearings, to permit unrestricted interchange of the car. This criteria prohibits obstruction of the axle bearings by surrounding component structure and thus allows temperature sensing by the hot-box detectors located along the side of the railroad track.

Thus, it is highly desirable to incorporate an equalizer beam with high-speed freight and passenger trucks that does not require the conventional drop shape and which is also hot-box detector compatible. However, challenges must be overcome. Cost and assembly and disassembly of parts is always a concern in the freight industry. In addition, since the wheelbase must be short in freight trucks, conventional single equalizer beams mounted atop the axlebox are impractical because the drop or vertical portion of the beam must be fitted between the inner pedestal jaw and the equalizer spring seat thereby necessitating an extended wheelbase. Conventional dual equalizer beams obstruct large portions of the journal bearing assemblies rendering the conventional dual equalizer beam unacceptable for unrestricted interchange service. Further, freight trucks require an unsprung location for mounting conventional brake beam guides. The only practical location to mount brake beam guides on an equalizer beam truck is off the equalizer beam.

Most passenger railcars use conventional equalizer beams, that is, beams that span the truck axles and set on top of the axleboxes. It is advantageous and highly desirable to use an equalizer beam that is hot-box detector compatible so as to not interfere with the axle bearing temperature detection scanners. Accordingly, an object of the present invention is to overcome the problems associated with conventional equalizer beams on freight and passenger vehicles and still provide an equalizer beam that does not interfere with the hot-box scanners. It is a further object of the present invention to provide an equalizer beam that utilizes conventional brake beam guides and reduces the maintenance costs associated with removal and replacement of the conventional brake beams. Still further, an object of the present invention is to minimize cost and weight of equalizer beams and to make assembly and disassembly of an equalizer beam more efficient. In addition, it is an object of the invention to minimize the truck wheelbase.

SUMMARY OF THE INVENTION

The present invention overcomes the aforementioned problems with freight and passenger trucks in providing an underslung single equalizer beam, that is, a equalizer beam that is located below the axleboxes, which is also hot-box detector compatible. The underslung equalizer beam is cut from high-strength steel plate. The underslung beam is essentially a straight beam and therefore more efficient in the use of material, thereby minimizing offal. This significantly reduces the associated beam costs and weight because less material is required.

Furthermore, with the underslung equalizer beam, the truck wheelbase does not need to be extended to accommodate the beam. Since the underslung beam is located below the axleboxes, the beam does not occupy any space between the axlebox and the equalizer spring, nor does it pass through the truck frame.

Assembly and disassembly is more efficient. The underslung equalizer beam is removed by simply removing the equalizer pin connecting the beam to the equalizer support bracket on the axlebox. The beam then will drop down and away from the truck frame. This retrofitting can be accomplished in the field with simple hand tools with minimal truck disassembly.

Most importantly, the underslung single equalizer beam occupies space centered directly under the axle bearing and thus does not interfere with the hot-box scanners. As above, the hot-box scanners require a scan diagram around the axle bearing assemblies inboard and outboard of the bearing center line. While the conventional equalizer beams obstruct these areas, the single underslung beam does not obstruct the required hot-box scanner view areas.

Still further, the single equalizer beam provides adequate space for incorporating conventional brake beam guides in the equalizer spring seats. These equalizer spring seats are bolted onto the equalizer beam and accommodate the conventional low-cost brake beams used on freight trucks. The equalizer spring seats incorporating brake beam guides are so configured within the truck assembly as to allow the conventional brake beam to be removed and replaced without disassembly of the truck or removal of the truck from the car body, thus affording reduced maintenance costs compared to conventional freight car trucks.

Briefly stated, the present invention comprises at least two longitudinally spaced, transversely extending axles having wheels mounted to the axles. Transversely spaced longitudinally extending truck frames guide the axleboxes, the axleboxes being mounted to axle bearing assemblies which are mounted to the axles. Below the axles and mounted to the axleboxes are transversely spaced longitudinally extending equalizer beams that are hot-box detector compatible so as to not interfere with the hot box detection scanners located alongside the railroad track. Equalizer springs are mounted on the equalizer beams through equalizer spring seats. The equalizer springs support the vertical load of the truck frames. Swing hangers are depending from the truck frame and support the transversely mounted truck bolster and accomodate controlled lateral motion between the truck bolster and truck frame. Longitudinal motion between the truck bolster and truck frame is limited by chafing plates. Mounted on the equalizer beams integral with the equalizer spring seats are brake beam guides which accommodate conventional brake beams used on freight trucks.

The full range of objects, aspects and advantages of the invention are only appreciated by a full reading of this specification and a full understanding of the invention. Therefore, to complete this specification, a detailed description of the invention and the preferred embodiment follows, after a brief description of the drawings.

BRIEF DESCRIPTION OF THE DRAWINGS

The preferred embodiments of the invention will be described in relation to the accompanying drawings. In the drawings, the following figures have the following general nature.

In the accompanying drawings, like reference numerals are used throughout the various figures for identical structures.

DESCRIPTION OF THE PREFERRED EMBODIMENTS

Figure 3:
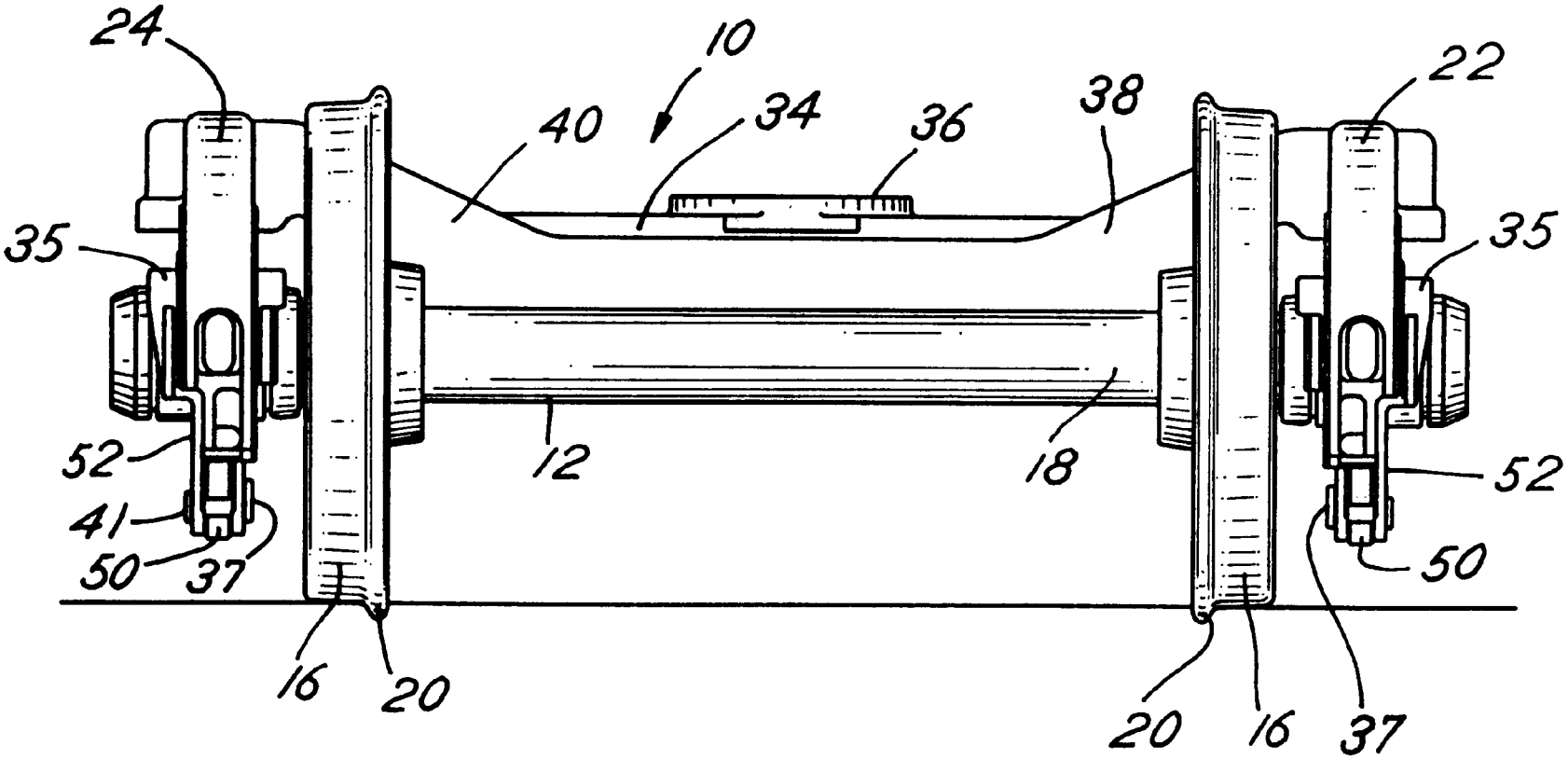
FIG. 3 is an end elevation view of the railcar truck of FIG. 2.

Referring to FIG. 3, a railway truck 10 includes wheel sets 12, comprising flanged railway wheels 16, spaced transversely from each other, and joined by a transversely extending axle 18. In service, the wheels 16 follow the rails of the underlying rail line, and in part, maintain transverse relation to the rails through opposed, integral inner flanges 20. The wheels and axles are separate steel components and joined together by pressing.

Figure 1:
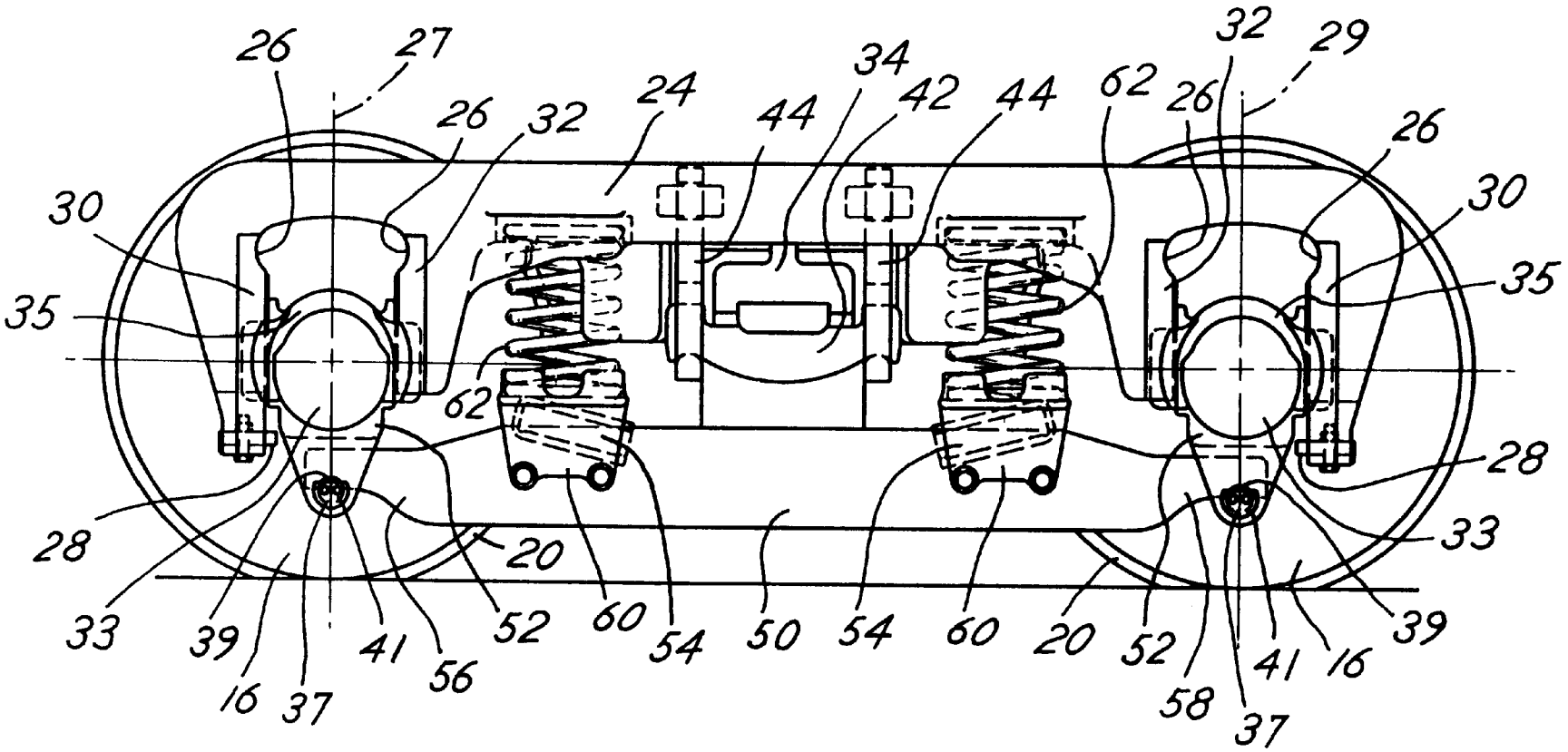
FIG. 1 is a side elevation view of a railcar truck illustrating the underslung equalizer beam of the present invention.
Figure 2:
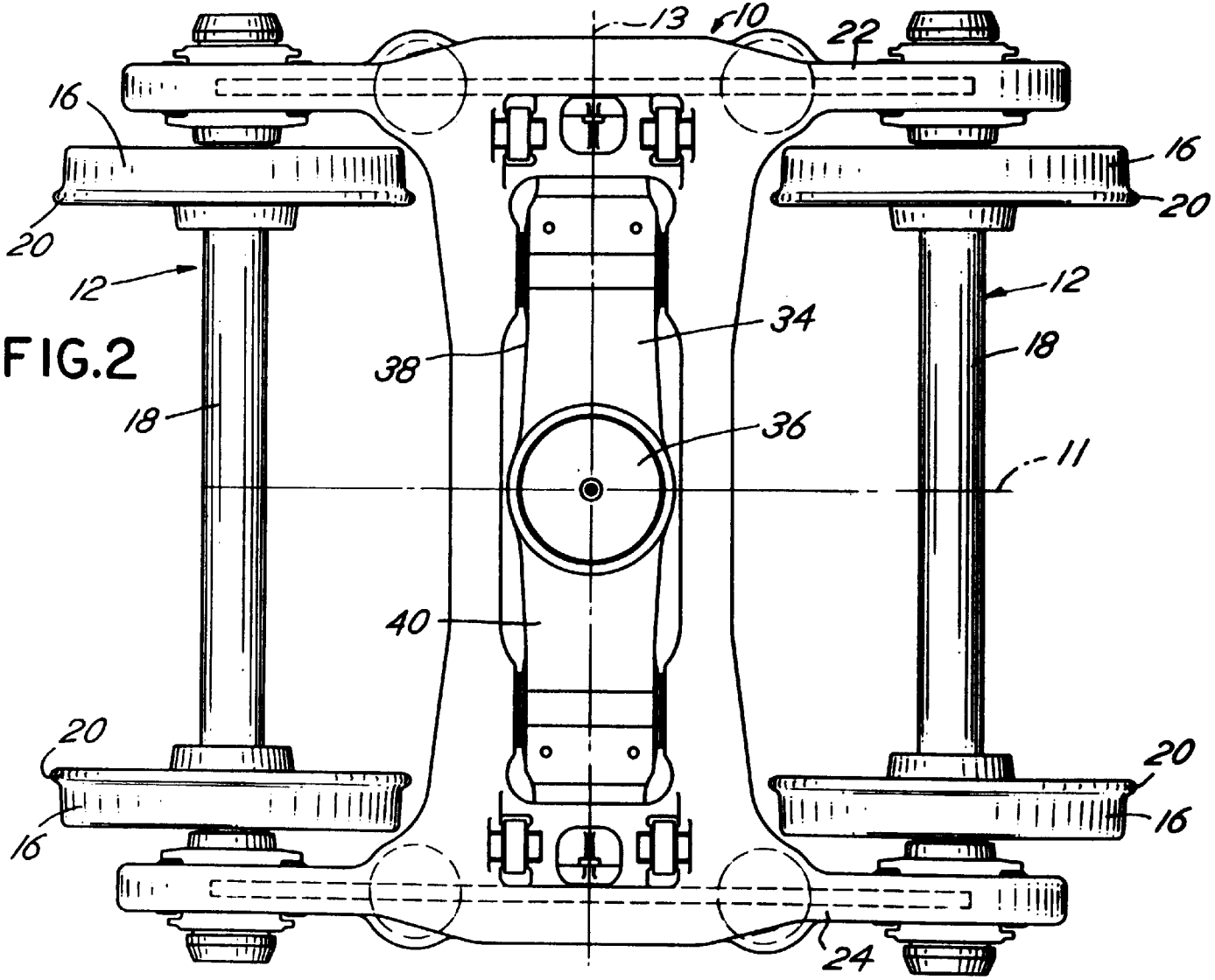
FIG. 2 is a plan view of the railcar truck of FIG. 1.

Referring to FIGS. 2 and 3, transversely spaced truck frames 22, 24 are supported on the wheel sets 12. The truck frames 22, 24 are longitudinally elongated, and referring to FIG. 1, where truck frame 24 is shown by example, define longitudinally spaced, downwardly opening pedestal jaws 26 along axle center lines 27, 29. A pair of pedestal liners 30, 32 are mounted in the jaws 26. Mounted between the pedestal liners 30, 32 are axleboxes 35 which rotatably receive the axle bearing assemblies 33 of the wheels 16. The axleboxes 35 are retained in the pedestal jaws 26 by means of an axlebox retainer 28.

Referring to FIG. 3, a transversely extending truck bolster 34 extends between the truck frames 22, 24. The bolster includes a center bowl 36, which, as illustrated in FIG. 2, is aligned on the center lines 11, 13 of the truck 10. Two opposed, elongated bolster arms 38, 40 extend transversely outward from beneath the center bowl 36. The bolster arms 38, 40 extend outward a length such that in service, the bolster arms 38, 40 extend through the swing hangers 44 and crossbars 42 depending from the truck frames 22, 24.

Referring again to FIG. 1, swing hangers 44 are located near the center of the truck frame 24 to vertically support the bolster 34 while accomodating controlled lateral motion of the bolster 34 relative to the truck frame 24. Swing hanger cross bar 42 connects the swing hangers 44 and carries the bolster 34. The swing hanger cross bar 42 transfers the vertical loading from the bolster 34 to the truck frame 24, through the swing hangers 44.

An equalizer beam 50 of the present invention is provided for enhanced railcar wheel load equalization. The equalizer beam 50 has respective ends removably connected to equalizer support brackets 52 which are mounted to the axleboxes 35. The equalizer beam 50 is an elongated longitudinally extending steel plate with a predetermined thickness and having tapered ends 56 and 58. The equalizer beam 50 is relatively straight and is cut and processed from a high-strength steel plate resulting in minimal offal. The tapered ends 56 and 58 are shaped for the purpose of decreasing the weight of the railcar truck and interfacing with the equalizer pin 37. Because the bending moment is decreased near the ends of the beam 50, a taper is possible from a stress standpoint. The tapered ends 56 and 58 are supported by the equalizer support bracket 52 by means of the equalizer pin 37. Located at each tapered end 56 and 58 is an equalizer beam notch 39 and an equalizer pin retainer 41 for holding the pin 37 in position.

The equalizer beam 50 is underslung, that is, located under the axle bearing assemblies 33 and truck frame 24 and depending from the axlebox 35. The equalizer beam 50 over its entire length remains in parallel relation to the railroad track. Mounted on the equalizer beam 50, inboard of the axle center lines 27 and 29, are the equalizer spring seats 60. The spring seats 60 support the equalizer springs 62 which provide for wheel load equalization. The equalizer springs 62 support the truck frame 24. As stated above, the inboard location of the equalizer springs enhance the wheel load equalization over uneven track.

Figure 4:
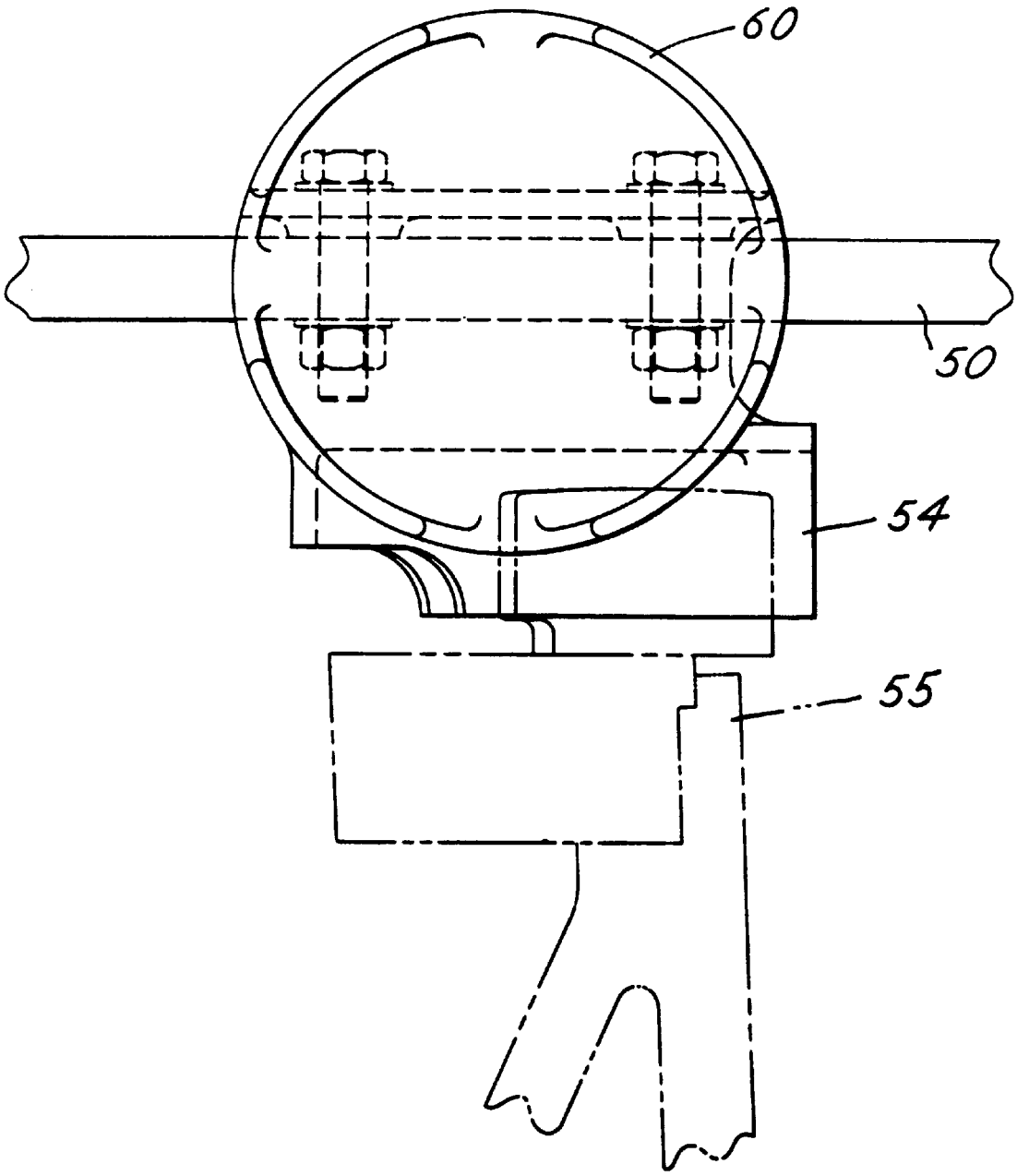
FIG. 4 is a partial plan view illustrating the equalizer spring seat and brake beam guide.
Figure 5:
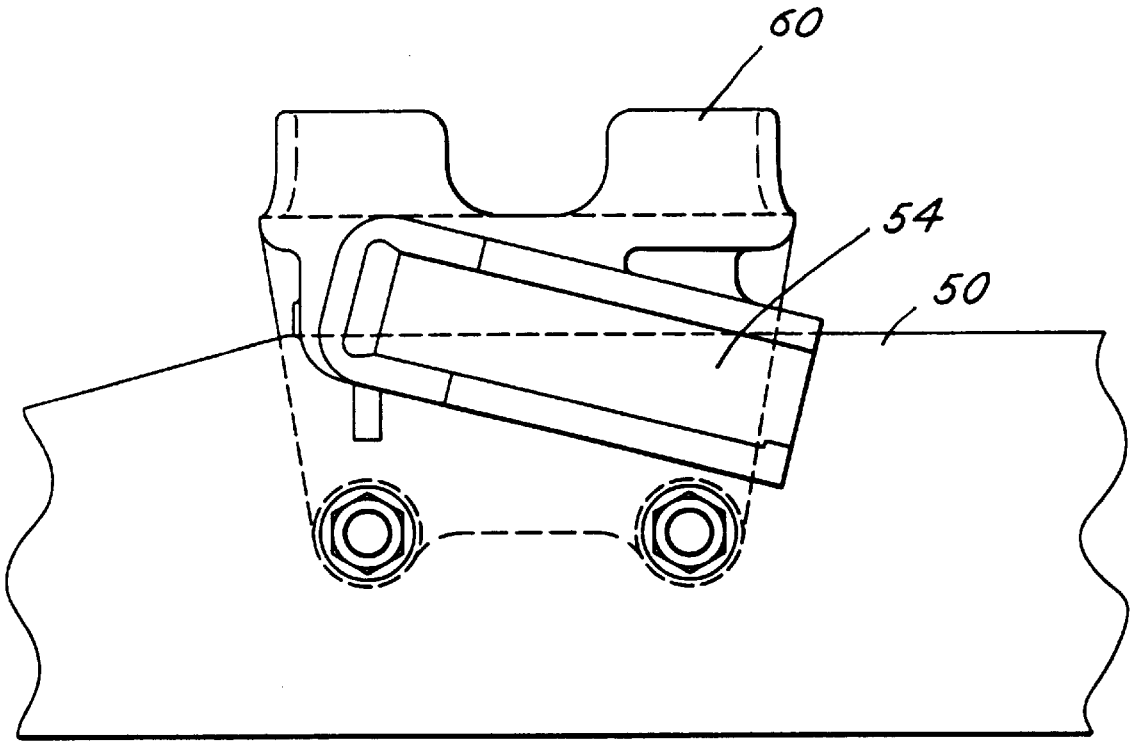
FIG. 5 is a partial side elevation view of FIG. 4.

Referring to FIGS. 4 and 5, integral with the spring seats 60 are the brake beam guides 54. The brake beam guides 54 are orientated inward toward the truck center line 11. The brake beam 55, is mounted in the brake beam guide 54 and when the railcar brakes are applied, the brake beam applies a radial force to the wheels 16 through the brake shoes, thereby stopping the railcar. Significantly, the spring seats 60 and accompanying brake beam guide 54 of the present invention accomodate the conventional low-cost brake beams on freight trucks.

Referring to FIG. 1, in operation, when a vertical load is applied to the truck bolster 34 and transmitted through the cross bars 42 and swing hangers 44 to the truck frame 24, the load is transferred through the equalizer springs 62 and equalizer spring seats 60 to the equalizer beam 50. The equalizer beam 50 then transfers the vertical load outward to the axleboxes 35.

Other than as described, the invented truck is essentially a conventional equalizer beam design. No change is made to the truck frames or bolsters. All components may be cast essentially as in the past, with automatic molding equipment. Thus, variation from conventional freight and passenger railway trucks and railcars is minimized while the benefits of the invention are achieved.

Most significantly, in sum, the underslung equalizer beam 50 of the present invention is clear of the axle bearing assemblies 33 and thus does not obstruct the hot-box scanners along the wayside of the railroad track. Moreover, equalizer spring seats 60 having integral brake beam guides 54 are mounted to the equalizer beam 50 accomodating the use of conventional brake systems. Potential applications of the present invention include both freight and passenger type railcars.

The preferred embodiments of the invention are now described as to enable a person of ordinary skill in the art to make and use the same. Variations of the preferred embodiment are possible without being outside the scope of the present invention. Therefore, to particularly point out and distinctly claim the subject matter regarded as the invention, the following claims conclude the specification.

What is claimed is:

1. A railway vehicle truck assembly comprising at least two longitudinally spaced, transversely extending axles, wheels mounted to the axles, the wheels defining a truck wheelbase, transversely spaced longitudinally extending truck frames mounted to axleboxes, the axleboxes mounted to axle bearing assemblies which are mounted to the axles, a transversely extending bolster mounted between the truck frames, a lightweight longitudinally extending equalizer beam having tapered ends located below the axles and removably mounted below the axles to the axleboxes, each of said tapered ends including a notch that receives a support pin suspended below a respective one of said axleboxes, a pair of equalizer spring seats removably mounted to the equalizer beam, the equalizer spring seats include brake beam guides, a brake beam removably mounted to each of the brake beam guides, whereby the transversely spaced longitudinally extending equalizer beam does not obstruct the axle bearing assemblies from being scanned by hot box detectors.

2. The railway vehicle truck assembly as in claim 1, the equalizer beam removably mounted to the support pins which are connected to equalizer brackets mounted to the axleboxes, whereby the equalizer beam can be removed and replaced without removal of the axles or axleboxes from the railway vehicle truck.

3. A railway vehicle truck assembly comprising at least two longitudinally spaced, transversely extending axles, wheels mounted to the axles, the wheels defining a truck wheelbase, transversely spaced longitudinally extending truck frames mounted to axleboxes, the axleboxes mounted to axle bearing assemblies, the axle bearing assemblies mounted to the axles, a transversely extending bolster mounted between the truck frames, transversely spaced, lightweight longitudinally extending equalizer beams having tapered ends located below the axles and removably mounted below the axles to equalizer support brackets mounted to the axleboxes, each of said tapered ends including a notch that receives a support pin suspended below a respective one of said axleboxes, a pair of equalizer spring seats removably mounted to the equalizer beams, the equalizer spring seats include brake beam guides, a brake beam removably mounted to each of the brake beam guides, whereby the equalizer beams do not obstruct the axle bearing assemblies from being scanned by hot box detectors.

4. The railway vehicle truck assembly as in claim 3, the equalizer beam removably mounted in parallel relation to the truck frames.

5. An underslung equalizer beam for a railway truck comprising a lightweight elongated steel plate having tapered ends adapted to be removably mounted directly below railway truck axle bearing assemblies, each of said tapered ends including a notch that receives a support pin, the support pin adapted to be suspended below a respective one of said bearing assemblies, a pair of equalizer spring seats removably mounted to the equalizer beam, the equalizer spring seats include brake beam guides, a brake beam removably mounted to each of the brake beam guides, whereby the underslung equalizer beam does not obstruct the axle bearing assemblies from being scanned by hot box detectors.

6. The underslung equalizer beam for a railway truck as in claim 5, the equalizer beam removably mounted in parallel relation to truck frames of the railway truck.

* * * * *